US010471442B2

(12) United States Patent
Katsushima et al.

(10) Patent No.: US 10,471,442 B2
(45) Date of Patent: Nov. 12, 2019

(54) CHARGING DEVICE AND ELECTRIC DUST COLLECTOR

(71) Applicant: AMANO CORPORATION, Kanagawa (JP)

(72) Inventors: Shinjirou Katsushima, Hamamatsu (JP); Yuji Makishima, Hamamatsu (JP); Syohei Nakagawa, Hamamatsu (JP); Masanori Hashimoto, Hamamatsu (JP); Takumi Seo, Hamamatsu (JP); Yoshiyuki Kisanuki, Hamamatsu (JP); Yoshihiro Tanaka, Hamamatsu (JP)

(73) Assignee: AMANO CORPORATION, Kanagawa (JP)

( * ) Notice: Subject to any disclaimer, the term of this patent is extended or adjusted under 35 U.S.C. 154(b) by 112 days.

(21) Appl. No.: 15/565,043

(22) PCT Filed: Apr. 4, 2016

(86) PCT No.: PCT/JP2016/061021
§ 371 (c)(1),
(2) Date: Oct. 6, 2017

(87) PCT Pub. No.: WO2016/163335
PCT Pub. Date: Oct. 13, 2016

(65) Prior Publication Data

US 2018/0093282 A1 Apr. 5, 2018

(30) Foreign Application Priority Data

Apr. 6, 2015 (JP) ..... 2015-077720

(51) Int. Cl.
*B03C 3/00* (2006.01)
*B04C 5/185* (2006.01)
(Continued)

(52) U.S. Cl.
CPC ..... *B04C 5/185* (2013.01); *B03C 3/12* (2013.01); *B03C 3/368* (2013.01); *B03C 3/40* (2013.01);
(Continued)

(58) Field of Classification Search
CPC .. B04C 5/185; B03C 3/00; B03C 3/12; B03C 3/368; B03C 3/40; B03C 3/41;
(Continued)

(56) References Cited

U.S. PATENT DOCUMENTS 5,922,111 A * 7/1999 Omi ..... B03C 3/025 55/DIG. 38
6,193,782 B1 * 2/2001 Ray ..... B03C 3/16 55/DIG. 38
(Continued)

FOREIGN PATENT DOCUMENTS

EP 1 829 615 A1 9/2007
JP H09-173899 A 7/1997
(Continued)

OTHER PUBLICATIONS

International Search Report issued in PCT/JP2016/061021; dated Jul. 5, 2016.
(Continued)

*Primary Examiner* — T. Bennett McKenzie
(74) *Attorney, Agent, or Firm* — Studebaker & Brackett PC

(57) ABSTRACT

A charging device or an electric dust collector has a downstream side grounded electrode plate 90 placed so as to obstruct the flow of a dust-containing air and having openings 91 for allowing the dust-containing air to pass therethrough, a supporting plate 60 placed on the upstream side of the electrode plate 90, and downstream side discharging electrodes 80*b* supported by the supporting plate 60 so as to
(Continued)

extend from the supporting plate 60 towards the electrode plate 90, and placed so as to correspond to the openings 91. The tip parts of the discharging electrodes 80*b* penetrate the openings 91 and project to the downstream side of the electrode plate 90, and the tip part of each discharging electrode 80*b* and the edge part of each opening 91 are positioned so as to have a predetermined gap between them.

10 Claims, 7 Drawing Sheets

(51) Int. Cl.

| | |
|---|---|
| ***B03C 3/41*** | (2006.01) |
| ***H01T 19/04*** | (2006.01) |
| ***B03C 3/40*** | (2006.01) |
| ***B03C 3/12*** | (2006.01) |
| ***B03C 3/36*** | (2006.01) |
| ***H01T 23/00*** | (2006.01) |

(52) U.S. Cl.
CPC ..... *B03C 3/41* (2013.01); *H01T 19/04* (2013.01); *H01T 23/00* (2013.01); *B03C 2201/06* (2013.01); *B03C 2201/10* (2013.01)

(58) Field of Classification Search
CPC . B03C 2201/06; B03C 2201/10; H01T 19/04; H01T 23/00
USPC ..... 55/430; 95/57–81
See application file for complete search history.

(56) References Cited

U.S. PATENT DOCUMENTS

| | | | | |
|---|---|---|---|---|
| 8,454,734 | B2 | 6/2013 | Haruna et al. | |
| 2006/0045789 | A1* | 3/2006 | Nasserrafi | C22C 14/00 420/420 |

FOREIGN PATENT DOCUMENTS

| | | | |
|---|---|---|---|
| JP | 2009-131829 | A | 6/2009 |
| JP | 2009-131830 | A | 6/2009 |
| JP | 2014-087732 | A | 5/2014 |
| KR | 10-2007-0086782 | A | 8/2007 |
| WO | 2016/163335 | A1 | 10/2016 |

OTHER PUBLICATIONS

An Office Action; "Notification of Reason for Refusal," issued by the Korean Patent Office dated Oct. 10, 2018, which corresponds to Korean Patent Application No. 10-2017-7023809 and is related to U.S. Appl. No. 15/565,043; with English language translation.

An Office Action; "Notice of Final Rejection," issued by the Korean Patent Office dated Apr. 15, 2019, which corresponds to Korean Patent Application No. 10-2017-7023809 and is related to U.S. Appl. No. 15/565,043; with English language translation.

* cited by examiner

CHARGING DEVICE AND ELECTRIC DUST COLLECTOR

TECHNICAL FIELD

The present invention relates to a charging device for charging particles, such as dust, mist or the like, in dust-containing air by using corona discharge generated by applying a high voltage, and an electric dust collector including the charging device.

BACKGROUND ART

Until now, an industrial electric dust collector has been used to purify air in a factory by sucking dust-containing air generated by processing machines such as a machining center and the like. Such an electric dust collector has a charging device for charging particles, such as dust, mist or the like, in dust-containing air by using corona discharge generated by applying a high voltage.

As this type of charging device, for instance, as disclosed in patent literature 1, a charging device which includes a first charging part based on a collision charging system having a first discharging electrode and a first opposite electrode, and a second charging part based on a diffusion charging system having a second discharging electrode and a second opposite electrode and arranged downstream from the first charging part is known.

Further, as disclosed in patent literature 2, an electric dust collector which uses multiple discharging electrode plates placed between two dust collecting electrode plates is also known.

PRIOR ART DOCUMENTS

Patent Literature

PATENT LITERATURE 1: Tokkai 2009-131830
PATENT LITERATURE 2: Tokkai hei 9-173899

SUMMARY OF INVENTION

Problems to be Solved by Invention

In the above-described charging device disclosed in patent literature 1, as a charging part, the second charging part based on the diffusion charging system is arranged downstream from the first charging part based on the collision charging system. However, in the charging device, when the concentration of fine particles generated by a processing machine becomes high under a certain sucking condition, or when the charging performance of the first charging part becomes lower over the operating time, the second charging part cannot sufficiently charge the fine particles. Specifically, the second charging part charges fine particles passing through air in which ions emitted from the second discharging electrode are diffused and floated. However, the fine particles do not always pass close by the emitted ions. As a result, it is not possible to sufficiently charge all the fine particles at all times. A dust collecting part arranged downstream from the charging part cannot collect uncharged particles. Therefore, in the situation where sucking of high-concentration fine particles is carried out or in some other situations, the efficiency of collecting particles becomes low, and the fine particles are leaked from an exhaust port.

Further, in the above-described electric dust collector disclosed in patent literature 2, the discharging electrode plates which have needle parts (discharging parts) arranged on the upstream side and the downstream side in an air current direction are placed between the two dust collecting electrode plates facing each other. However, in the electric dust collector, the holes formed in the dust collecting plates and the needle parts (discharging parts) do not face each other. This causes variation in charging state. Therefore, there is a possibility that fine particles passing through the holes are not sufficiently charged.

To solve the above-described problems, an object of the present invention is to provide a charging device which can sufficiently charge fine particles when the concentration of the fine particles becomes high or when the charging performance of a charging part becomes lower over the operating time, and an electric dust collector which has this charging device and makes it possible to sufficiently collect dust with a dust collecting part arranged on the downstream side, to prevent leakage of exhaust air and to keep high efficiency of dust collection.

Solution to Problem

To achieve the above-described object, a first charging device of the present invention is a charging device for charging particles such as dust, mist or the like in dust-containing air by using corona discharge generated by applying a high voltage, and characterized in that the charging device has: a downstream side grounded electrode plate which is placed so as to obstruct a flow of the dust-containing air and has a plurality of openings for allowing the dust-containing air to pass therethrough; a supporting plate which is placed on an upstream side of the downstream side grounded electrode plate in a direction of the flow of the dust-containing air; and a plurality of downstream side discharging electrodes which are supported by the supporting plate so as to extend from the supporting plate towards the downstream side grounded electrode plate, and placed so as to correspond to the plurality of openings of the downstream side grounded electrode plate respectively, tip parts of the plurality of downstream side discharging electrodes penetrate the plurality of openings respectively and project to a downstream side of the downstream side grounded electrode plate in the direction of the flow of the dust-containing air, and each of the tip parts of the plurality of downstream side discharging electrodes and each of edge parts of the plurality of openings are positioned so as to have a predetermined gap between them.

In the first charging device of the present invention, the direction of the flow of the dust-containing air passing through the openings of the downstream side grounded electrode plate and a direction of the emission of ions from tip parts of the downstream side discharging electrodes except the peripheries of the tip parts of the downstream side discharging electrodes are opposite to each other. This makes it easier for the emitted ions to collide with dust, mist or the like in the dust-containing air. Accordingly, it becomes easier to charge dust, mist or the like in the dust-containing air, and therefore, it is possible to increase charging efficiency. Further, the tip parts of the downstream side discharging electrodes project to the downstream side of the downstream side grounded electrode plate in the direction of the flow of the dust-containing air. Therefore, the dust-containing air is not concentrated to the tip parts of the downstream side discharging electrodes, and further, since the directions of the emitted ions and the direction of the flow of the dust-containing air are the same as each other in the peripheries of the tip parts of the downstream side discharging electrodes, the tip parts of the downstream side discharging electrodes hardly get dirty. This makes it possible to keep the discharging stable for a long time and enhance durability.

A second charging device of the present invention is characterized in that the charging device has: an upstream side grounded electrode plate which is placed on an upstream side of the supporting plate in the direction of the flow of the dust-containing air so as to obstruct the flow of the dust-containing air, and has a plurality of openings for allowing the dust-containing air to pass therethrough; and a plurality of upstream side discharging electrodes which are supported by the supporting plate so as to extend from the supporting plate towards the upstream side grounded electrode plate, and placed so as to correspond to the plurality of openings of the upstream side grounded electrode plate respectively, tip prats of the plurality of upstream side discharging electrodes are positioned on a downstream side of the upstream side grounded electrode plate in the direction of the flow of the dust-containing air, and each of the tip parts of the plurality of upstream side discharging electrodes and each of edge parts of the plurality of openings of the upstream side grounded electrode plate are positioned so as to have a predetermined gap between them.

The second charging device of the present invention has the upstream side discharging electrodes in addition to the downstream side discharging electrodes. Therefore, it is possible to increase discharging points, reduce load of each of the discharging electrodes, and enhance durability. Further, even if there are some uncharged fine particles because of the reduction of the charging efficiency of the upstream side discharging electrodes caused by dirt on the upstream side discharging electrodes, it is possible to charge such fine particles with the downstream side discharging electrodes.

A third charging device of the present invention is characterized in that the upstream side grounded electrode plate and the downstream side grounded electrode plate are shaped like a flat plate respectively, and placed so as to be perpendicular to the direction of the flow of the dust-containing air, to face each other and to be parallel to each other.

In the third charging device of the present invention, it is possible to shorten the length of charging device in a longitudinal direction (the direction of the flow of the dust-containing air) and downsize the charging device.

A fourth charging device is characterized in that an area of each of the plurality of openings of the downstream side grounded electrode plate and a total area of the plurality of openings of the downstream side grounded electrode plate are larger than an area of each of the plurality of openings of the upstream side grounded electrode plate and a total area of the plurality of openings of the upstream side grounded electrode plate respectively.

In the fourth charging device, it is possible to make an air current between the upstream side grounded electrode plate and the downstream side grounded electrode plate smooth, and prevent the downstream side grounded electrode plate from improperly affecting the rectifying effect of the upstream side grounded electrode plate.

A fifth charging device is characterized in that, when viewed from the direction of the flow of the dust-containing air, the plurality of openings of the upstream side grounded electrode plate are arranged on both sides of the supporting plate in a zigzag pattern, and the plurality of openings of the downstream side grounded electrode plate are arranged such that their centers correspond to the supporting plate.

In the fifth charging device, the supporting plate is placed in a place where the rectifying effect of the upstream side grounded electrode plate is less affected. Therefore, it is possible to make an air current between the upstream side grounded electrode plate and the downstream side grounded electrode plate smooth. Further, it is possible to ensure the necessary areas of the openings in the grounded electrode plate while maintaining strength of the upstream side grounded electrode plate. Furthermore, it is possible to separate the discharge electrodes adjacent to each other by a predetermined distance and thus prevent improper influence caused by touching the discharging electrodes each other.

A sixth charging device of the present invention is characterized in that each of the plurality of upstream side discharging electrodes and each of the plurality of downstream side discharging electrodes are formed in one piece.

In the sixth charging device of the present invention, it is possible to reduce the number of parts and efficiently produce the upstream side discharging electrodes and the downstream side discharging electrodes, and thereby enhance economy.

A seventh charging device of the present invention is characterized in that each of the plurality of upstream side discharging electrodes and the plurality of downstream side discharging electrodes is shaped like a cone, and has a tip diameter in a range from 0.05 to 0.15 mm.

In the seventh charging device of the present invention, it is possible to increase discharging currents generated from the tip parts of the upstream side discharging electrodes and the downstream side discharging electrodes, and further enhance charging efficiency. Moreover, since strong corona discharges are generated from the tip parts of the upstream side discharging electrodes and the downstream side discharging electrodes, the tip parts hardly get dirty. This makes it possible to continuously carry out stable discharge.

An eighth charging device of the present invention is characterized in that each of the plurality of upstream side discharging electrodes and the plurality of downstream side discharging electrodes is formed by using a member made of Ti-6Al-4V and shaped like a fine line or a needle.

In the eighth charging device of the present invention, it is possible to decrease ozone generation amount and stabilize discharge, and further, it is possible to reduce wear loss of the discharge electrodes and improve processability. Furthermore, since Ti-6Al-4V has excellent toughness, the discharging electrodes are hardly broken and have high durability.

A ninth charging device of the present invention is characterized in that the tip parts of the plurality of upstream side discharging electrodes are alternately bent so as to correspond to the plurality of openings of the upstream side grounded electrode plate positioned adjacent to both sides of the supporting plate.

In the ninth charging device of the present invention, the upstream side discharging electrodes can generate corona discharge to the openings adjacent to the both sides of the supporting plate. Therefore, it is possible to decrease the number of the supporting plates and reduce costs.

A tenth charging device of the present invention is characterized in that, when viewed from the direction of the flow of the dust-containing air, the tip parts of the plurality of upstream side discharging electrodes and the plurality of downstream side discharging electrodes are arranged so as to correspond to centers of the plurality of openings, respectively.

In the tenth charging device of the present invention, it is possible to carry out uniform charging to the dust-containing air passing through the openings and enhance charging efficiency. Further, it is possible to make the balance of the discharging areas generated by corona discharge in the respective openings uniform and prevent the generation of abnormal discharge.

An electric dust collector of the present invention is characterized in that the charging device, a dust collecting device for collecting the particles charged by the charging device, and a fan for sucking the dust-containing air are arranged in series in this order from an upstream side in the direction of the flow of the dust-containing air.

In the electric dust collector of the present invention, since the charging device, the dust collecting device and the fan are arranged in series, it is possible to make the height of the device smaller. Further, by mounting the charging device with a small length in a longitudinal direction, it is possible to make the length of the electric dust collector smaller in a longitudinal direction and downsize the products.

Advantageous Effects of Invention

By the present invention, various advantageous effects can be obtained. Specifically, it is possible to sufficiently charge dust, mist or the like in the dust-containing air and enhance charging efficiency.

EMBODIMENTS TO CARRY OUT INVENTION

Figure 1:
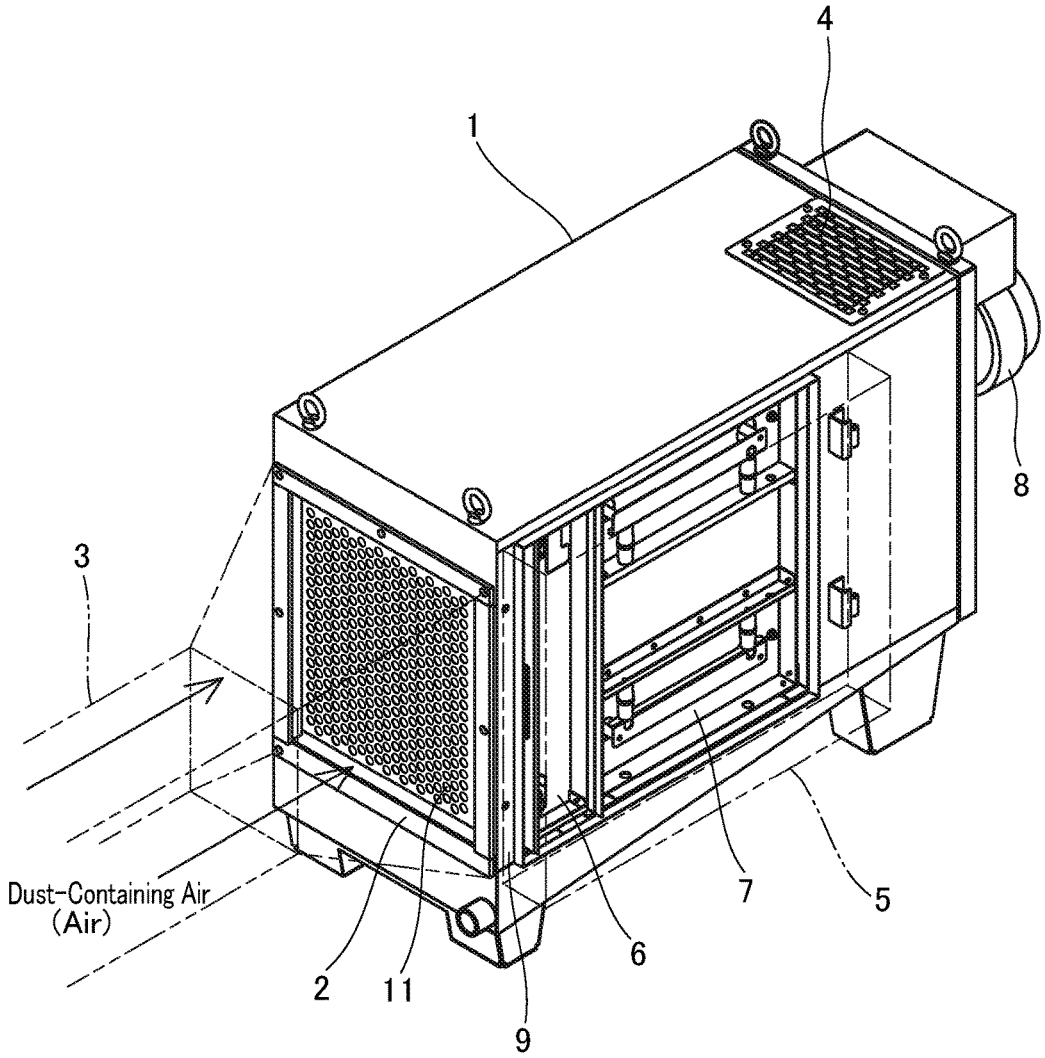
FIG. 1 is a perspective view showing a construction of the whole of an electric dust collector of an embodiment of the present invention.

We will explain an electric dust collector of an embodiment of the present invention, referring to the drawings.

First, we will explain the construction of the whole of the electric dust collector of the embodiment of the present invention and its operation, referring to FIG. 1. FIG. 1 is a perspective view showing the construction of the whole of the electric dust collector of the embodiment of the present invention.

The electric dust collector of the embodiment of the present invention has a main body case 1. The main body case 1 has a sucking port 2 in the front side thereof. An inlet duct 3 is connected to the sucking port 2. Further, the main body case 1 has an exhaust port 4 in the back side of an upper face thereof, and a door 5 is attached to a right side face of the main body case 1 so as to be able to be opened and closed. For convenience, the inlet duct 3 and the door 5 are depicted in dashed-two dotted lines in FIG. 1 to show the interior of the electric dust collector.

In the interior of the main body case 1, a preprocessing unit 9, a charging device 6, a dust collecting device 7 and a fan (not shown in drawings) are arranged in series in this order along the flow of dust-containing air (shown as "Air" in the drawings). A motor 8, which is a driving source for rotating the fan, is attached to a back side face of the main body case 1.

The preprocessing unit 9 is formed into a single unit by combining a rectifying plate 11 made by using a metal plate with an approximately quadrilateral shape and with multiple holes, and a metal demister (not shown) placed on the downstream side of the rectifying plate 11 in the direction of the flow of the dust-containing air.

The details of the charging device 6 is described later.

As the dust collecting device 7, for instance, a type of dust collecting device 7 not using a rotational electrode plate which is disclosed in patent literature No. Tokkai 2007-22717 is used. Incidentally, as the dust collecting device 7, for instance, a type of dust collecting device using a rotational electrode plate which is disclosed in patent literature No. Tokkai 2014-87732 or other types of dust collecting devices may be used.

Figure 2:
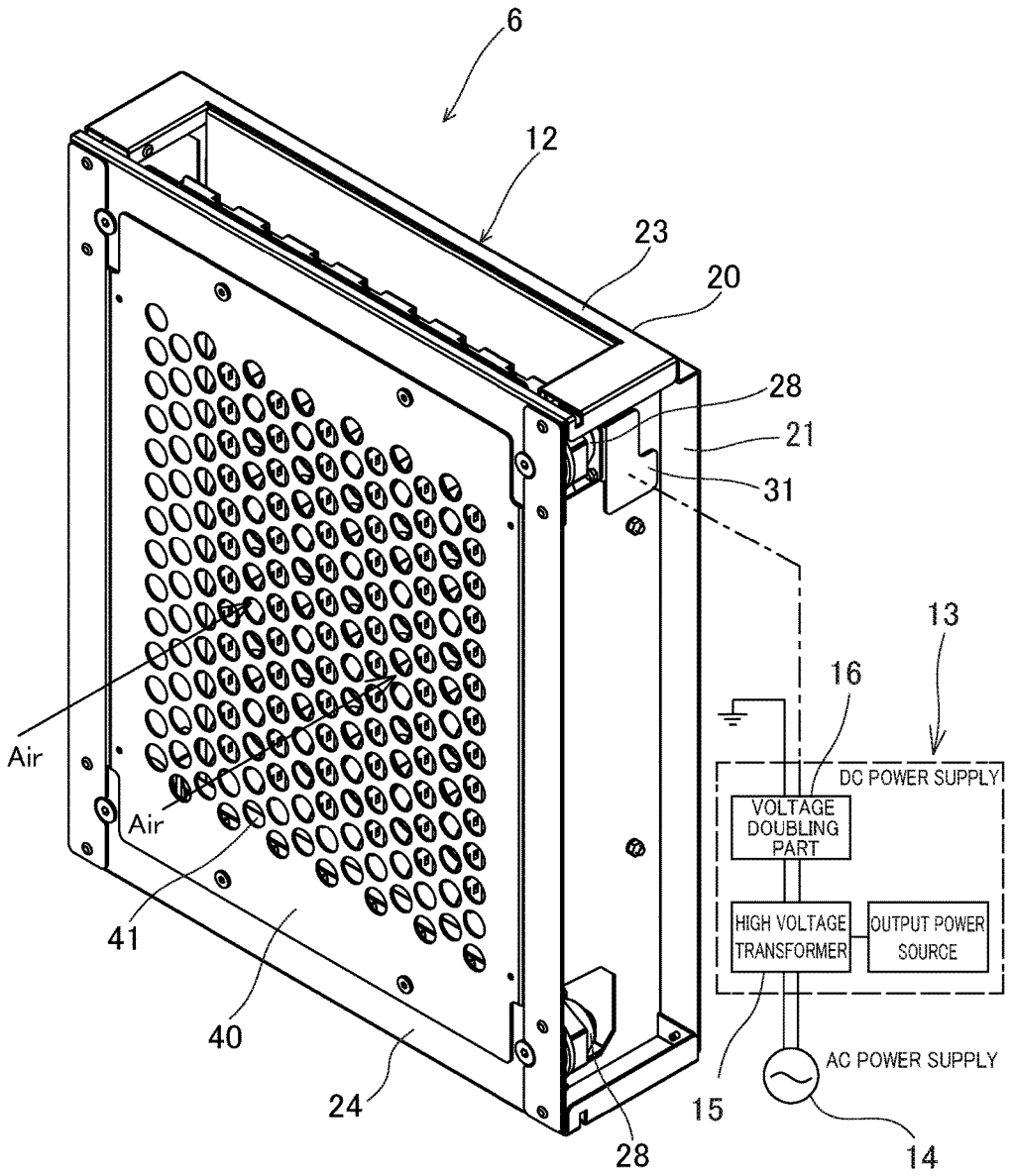
FIG. 2 is a perspective view showing a charging device of the electric dust collector of the embodiment of the present invention from its front side.
Figure 3:
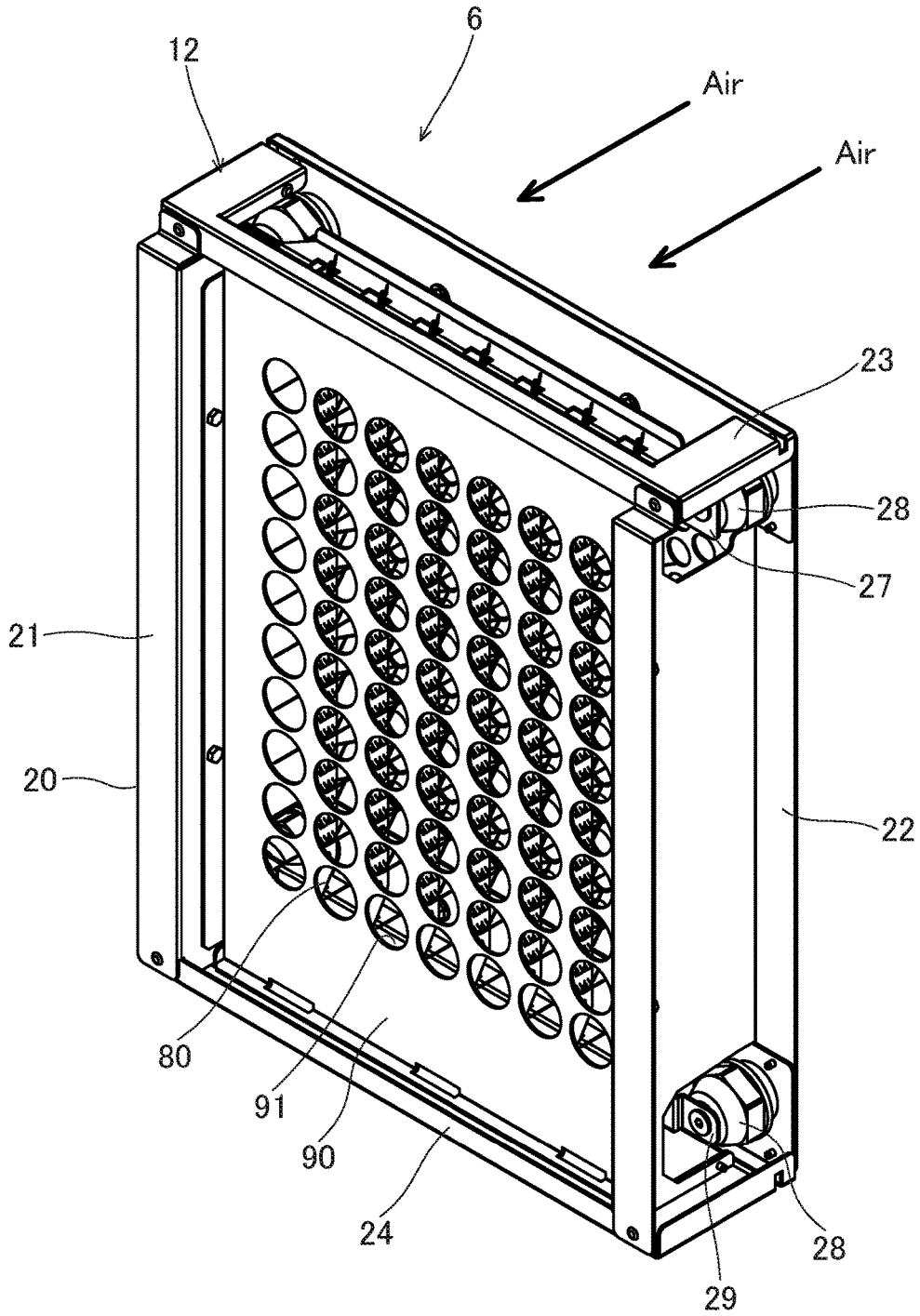
FIG. 3 is a perspective view showing the charging device of the electric dust collector of the embodiment of the present invention from its back side.
Figure 4:
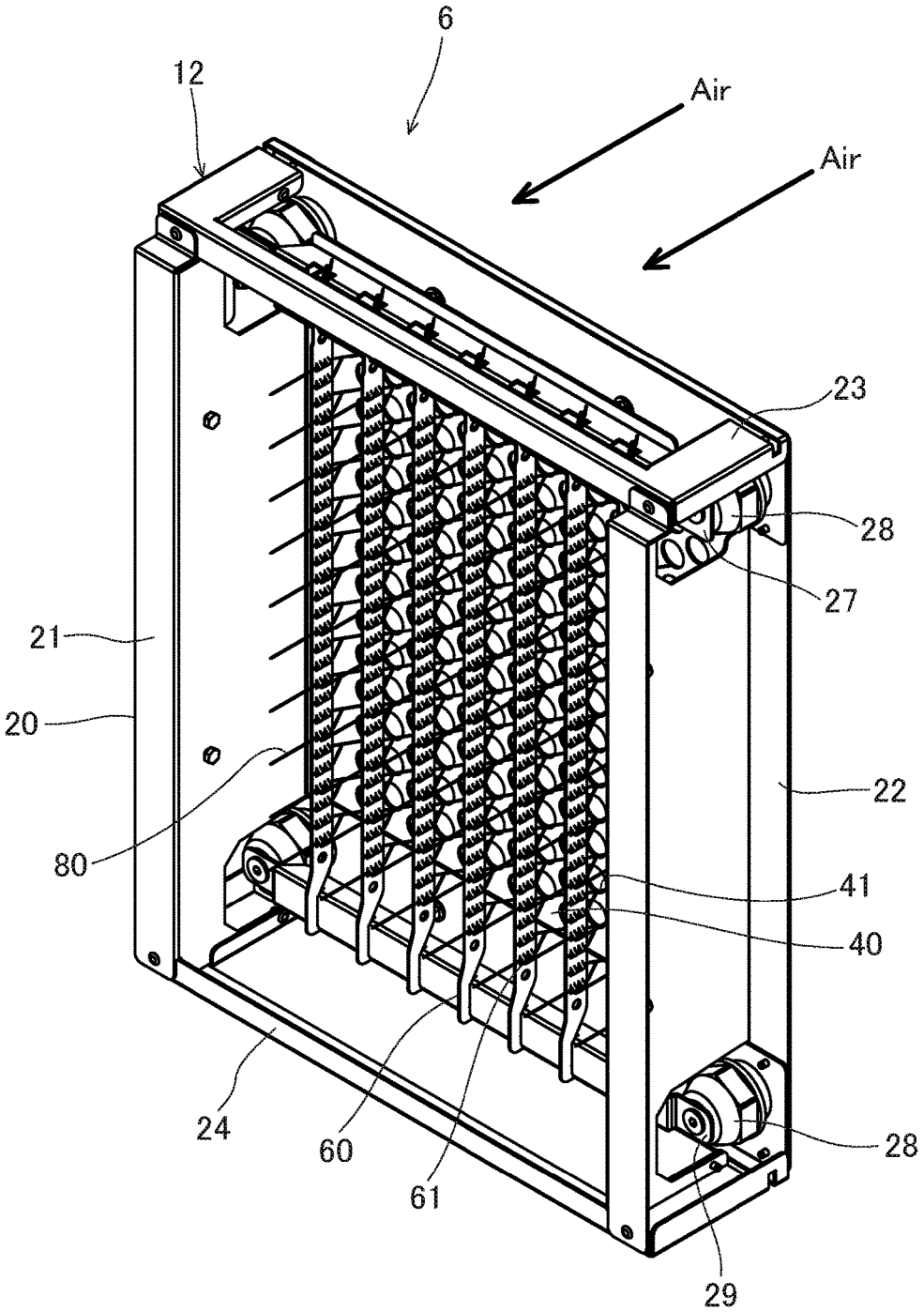
FIG. 4 a perspective view showing the back side of the charging device of the electric dust collector in the state where a downstream side grounded electrode plate is removed.
Figure 5:
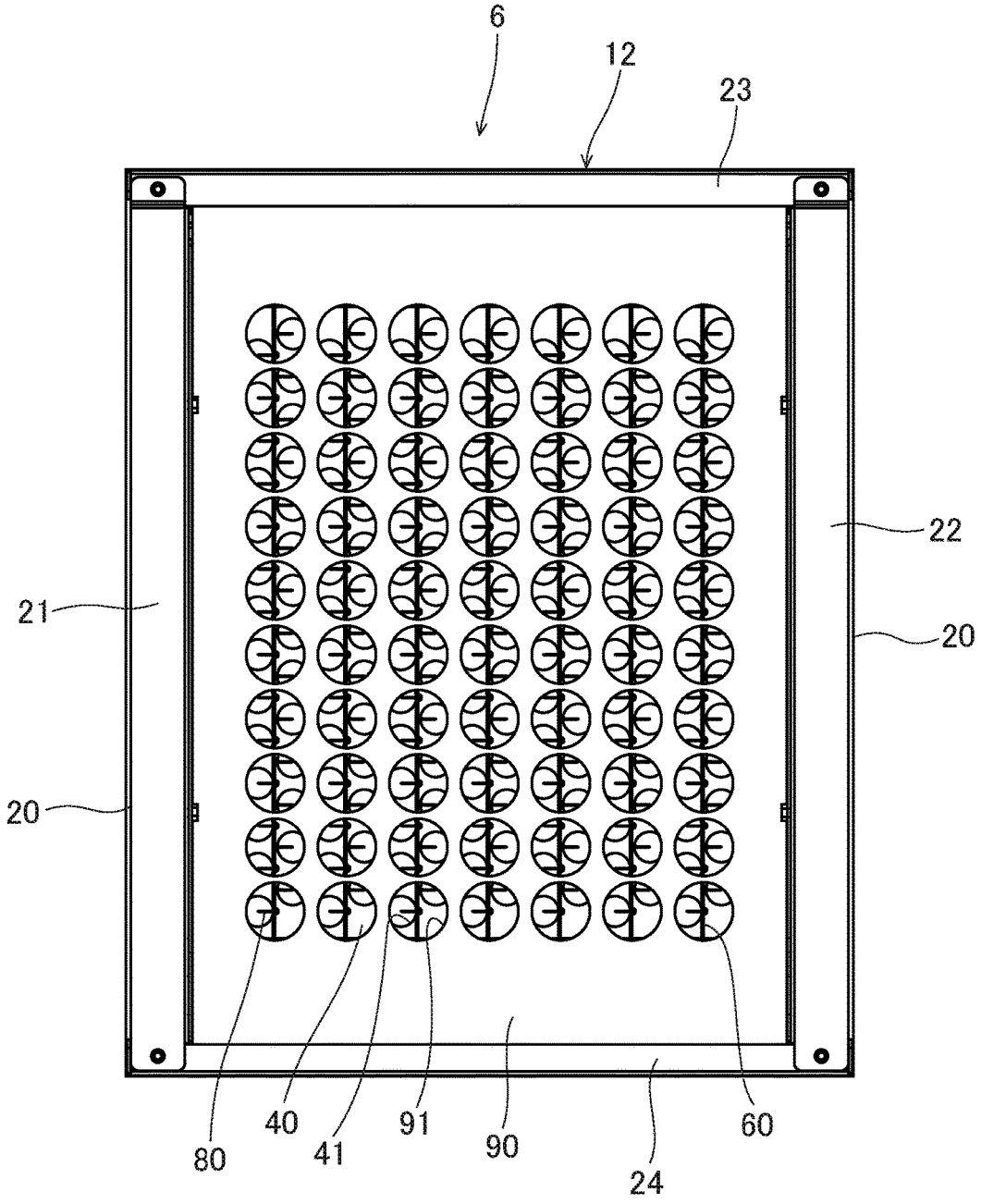
FIG. 5 is a back view showing the charging device of the electric dust collector.
Figure 6:
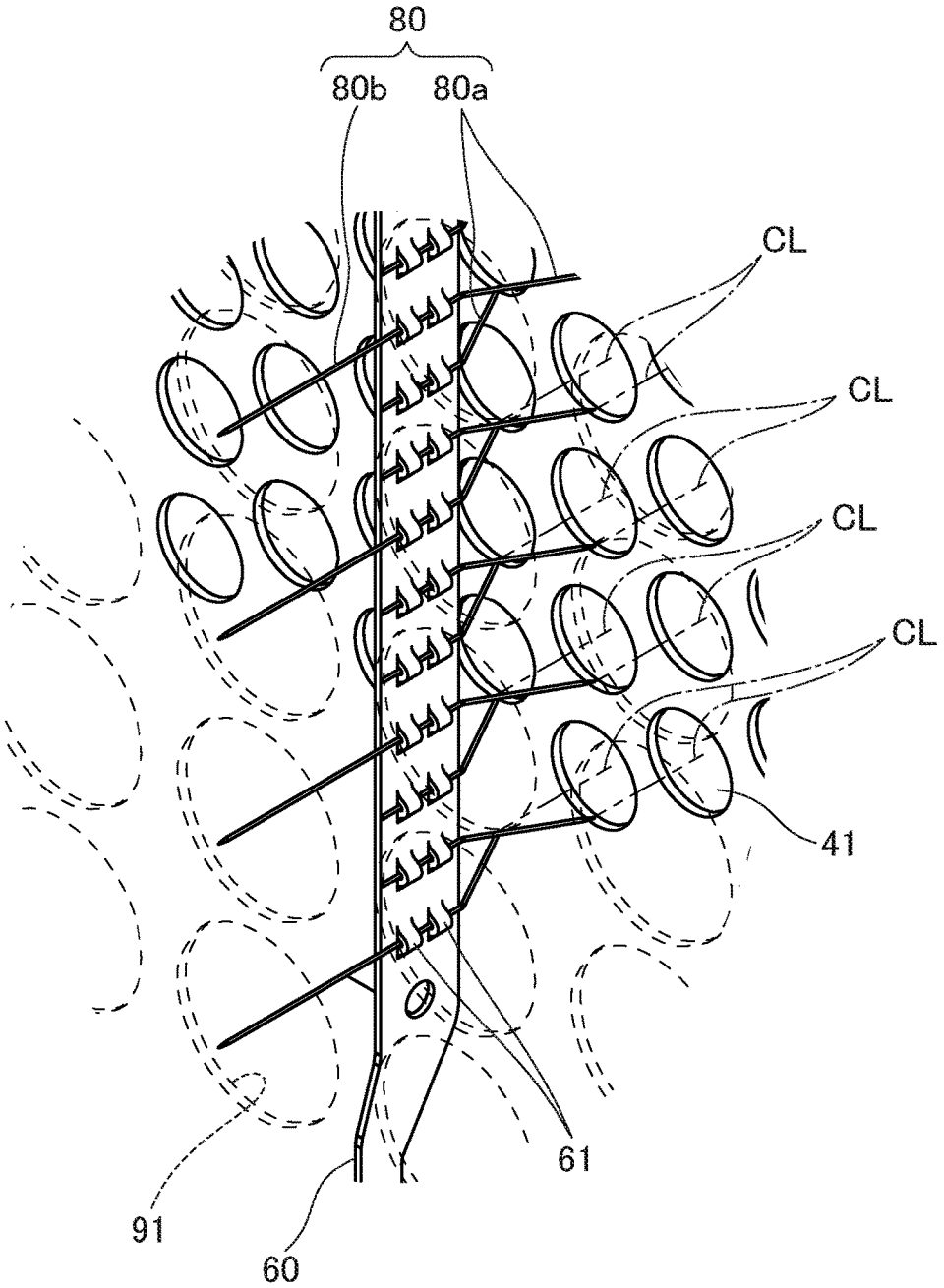
FIG. 6 is an enlarged perspective view showing a part of the charging device of the electric dust collector of the embodiment of the present invention.
Figure 7:
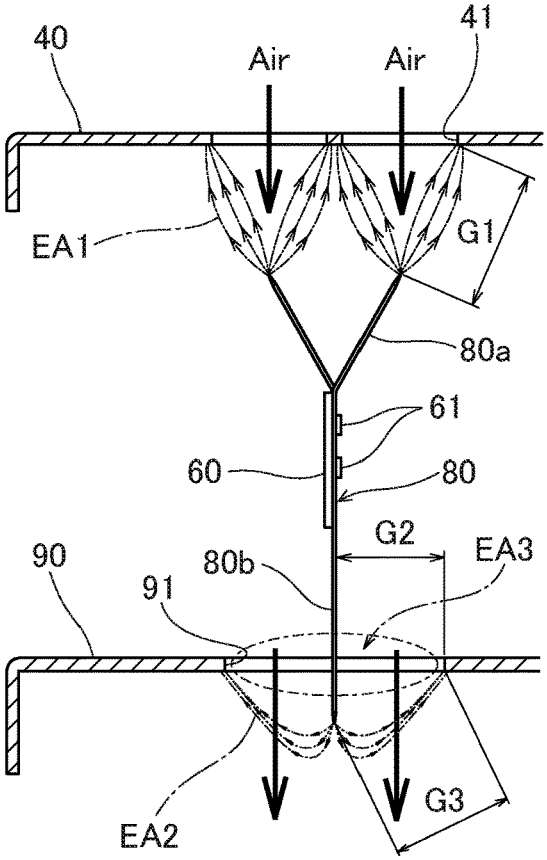
FIG. 7 is an enlarged sectional view showing a part of the charging device of the electric dust collector of the embodiment of the present invention.
Figure 8:
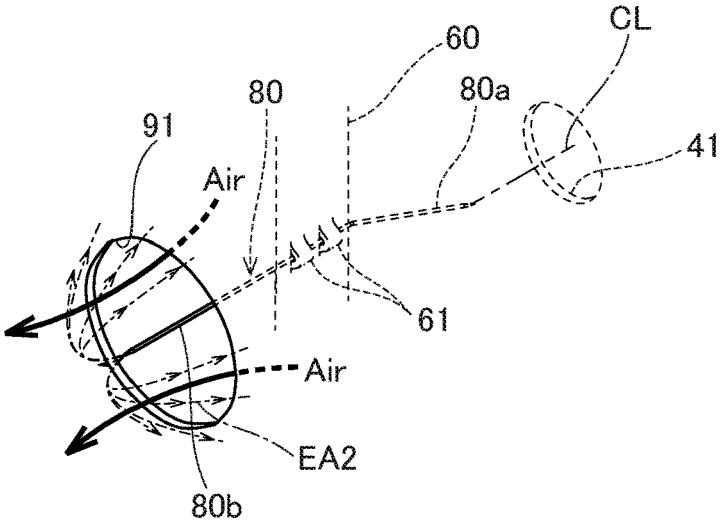
FIG. 8 is a perspective view showing a discharging area of a downstream side discharging electrode in the charging device of the electric dust collector of the embodiment of the present invention.

Next, we will explain the charging device 6 of the electric dust collector of the embodiment of the present invention, referring to FIG. 2 to FIG. 6. FIG. 2 is a perspective view showing the charging device 6 from its front side, FIG. 3 is a perspective view showing the charging device 6 from its back side, FIG. 4 a perspective view showing the interior of the charging device 6 from its back side, FIG. 5 is a back view showing the charging device 6, FIG. 6 is an enlarged perspective view showing a part of the charging device 6, FIG. 7 is an enlarged sectional view showing a part of the charging device 6, and FIG. 8 is a perspective view showing a discharging area of a downstream side discharging electrode.

The charging device 6 has a charging device body 12, and a high voltage power supply part 13 for applying a high voltage to the charging device body 12. The high voltage power supply part 13 boosts a voltage of an AC power supply 14 with a high voltage transformer 15, and then converts the alternate current into a direct current and further boosts the voltage with a voltage doubling part 16, and thus generates a high voltage of approximately 10 kV. The high voltage power supply part 13 also functions as an output controlling part for controlling the output of a high voltage to be applied to the charging device body 12.

The charging device body 12 has a frame body 20 shaped like a quadrangle when viewed from the direction of the flow of the dust-containing air, an upstream side grounded electrode plate 40 attached to the inside of the frame body 20 and grounded, a downstream side grounded electrode plate 90 placed on the downstream side of the upstream side grounded electrode plate 40 in the direction of the flow of the dust-containing air so as to be parallel to the upstream side grounded electrode plate 40, supporting plates 60 placed between the upstream side grounded electrode plate 40 and the downstream side grounded electrode plate 90, and discharge needle electrodes 80, which serves as discharging electrodes, supported by the supporting plates 60. The upstream side grounded electrode plate 40 and the downstream side grounded electrode plate 90 are grounded.

The frame body 20 has left and right pillars 21, 22 standing so as to face each other, an upper connecting member 23 crossing between upper end parts of the pillars 21 and 22, and a lower connecting member 24 crossing between lower end parts of the pillars 21 and 22.

An upper attaching member 27 is placed below the upper connecting member 23 in the upper end parts of the left and right pillars 21, 22 through insulators 28 so as to extend in a left and right direction. A lower attaching member 29 is placed in the lower end parts of the left and right pillars 21, 22 through insulators 28 so as to extend in a left and right direction. In this way, the upper attaching member 27 and lower attaching member 29 are supported by the frame body 20 and insulated from the frame body 20.

The lower attaching member 29 has multiple cutouts (not shown) arranged at a predetermined spacing and each shaped like a slit extending in an up and down direction. A power feeding member 31 is attached to a right end part of the upper attaching member 27, and the high voltage power supply 13 is connected to the power feeding member 31. The high voltage of approximately 10 kV is supplied from the high voltage power supply 13 to the power feeding member 31, the upper attaching member 27, the supporting plates 60 and the discharging needle electrodes 80, and corn-shaped discharging areas EA1 are formed by corona discharges formed between tip parts of the discharging needle electrodes 80 and openings 41.

As well shown in FIG. 2, the upstream side grounded electrode plate 40 is shaped like a flat plate by using one sheet of conductive metal (iron in an example) shaped like a quadrangle and having multiple openings 41 each shaped like a circular hole. The upstream side grounded electrode plate 40 is detachably attached to the frame body 20 with an attaching and detaching means, such as detachable rivets, and arranged so as to obstruct the flow of the dust-containing air (arranged so as to be perpendicular to the direction of the flow of the dust-containing air). The openings 41 are arranged in rows each extending in an up and down direction, and arranged at a regular spacing in each row. The openings 41 are arranged in zigzag in such a way that the positions of the openings 41 are shifted in an up and down direction by the distance equal to half of the size of each opening 41 between two rows adjacent to each other in a left and right direction.

In this embodiment, in the upstream side grounded electrode plate 40, the fourteen openings 41 are arranged in an up and down direction, and the fourteen rows of the openings 41 are arranged in a left and right direction, and thus, a total of one hundred and ninety-six openings 41 are formed. The diameter of each opening 41 is set at 15 mm, and the aperture ratio is 37.2%. The reasons why the number of openings 41 and the area (diameter) of each opening 41 are set in this manner are as follows. Under the conditions where the quantity of the flow of the dust-containing air to be treated by the electric dust collector is predetermined, and the gap between each discharging needle electrode 80 and an edge part of each opening 41 is set at a constant value, if the area of each opening 41 is too small, the velocity of the flow of the dust-containing air becomes high, so that contacting and charging time between the discharging areas EA1 generated by ions emitted from the discharging needle electrodes 80 and particles in the dust-containing air becomes short, whereas if the area of each opening 41 is too large, the velocity of the flow of the dust-containing air becomes low, however, the discharging areas EA1 generated by the discharging needle electrodes 80 become small, so that the particles cannot be sufficiently charged, and further, the number of openings 41 in the upstream side grounded electrode plate 40 decreases, so that space efficiency becomes worse.

As well shown in FIG. 3 and FIG. 5, the downstream side grounded electrode plate 90 is shaped like a flat plate by using one sheet of conductive metal (iron in an example) shaped like a quadrangle and having multiple openings 91 each shaped like a circular hole. The downstream side grounded electrode plate 90 is detachably attached to the frame body 20 with an attaching and detaching means, such as detachable rivets, and arranged so as to obstruct the flow of the dust-containing air (arranged so as to be perpendicular to the direction of the flow of the dust-containing air). The openings 91 of the downstream side grounded electrode plate 90 are arranged in rows each extending in an up and down direction, and arranged at a regular spacing. The area of each opening 91 and the total area of the openings 91 of the downstream side grounded electrode plate 90 are larger than the area of each opening 41 and the total area of the openings 41 of the upstream side grounded electrode plate 40 respectively.

In this embodiment, in the downstream side grounded electrode plate 90, the ten openings 91 are arranged in an up and down direction, and the seven rows of the openings 91 are arranged in a left and right direction, and thus, a total of seventy openings 91 are formed. The diameter of each opening 91 is set at 28.5 mm, and the aperture ratio is 47.9%.

Incidentally, it is optimum that the openings 41 of the upstream side grounded electrode plate 40 and the openings 91 of the downstream side grounded electrode plate 90 are in the shape of a perfect circle as described above. However, they may be shaped like an approximately circle such as a regular polygon. Further, a commercially available punching metal plate can be used for the upstream side grounded electrode plate 40 or the downstream side grounded electrode plate 90. This can further reduce costs.

Each of the supporting plates 60 is formed by using a rectangular plate which is long in a longitudinal direction. The supporting plates 60 are placed in every other space between adjacent ones of the rows of openings 41 in a left and right direction in the upstream side grounded electrode plate 40, and arranged in such a way that the position of each supporting plate 60 matches the positions of the centers of the openings 91 of the downstream side grounded electrode plate 90. In this embodiment, the seven supporting plates 60 are arranged so as to be perpendicular to the upstream side grounded electrode plate 40 and the downstream side grounded electrode plate 90. In this configuration, the supporting plates 60 are positioned so as not to overlap the openings 41 of the upstream side grounded electrode plate 40 when viewed from the direction of the flow of the dust-containing air, and each gap between adjacent supporting plates 60 is sufficiently maintained so that abnormal discharge does not occur. Incidentally, in this embodiment, the supporting plates 60 are arranged so as to be parallel to the direction of the flow of the dust-containing air and perpendicular to the upstream side grounded electrode plate 40 and the downstream side grounded electrode plate 90. However, for instance, the supporting plates 60 may be arranged so as not to be perpendicular to the upstream side grounded electrode plate 40 or downstream side grounded electrode plate 90 as long as the supporting plates 60 can be arranged so as not to overlap the openings 41.

An upper end part of each supporting plate 60 is attached to the upper attaching member 27 with a spring (not shown) connecting between a hook hole (not shown) formed in the upper end part and the upper attaching member 27. A lower end part of each supporting plate 60 is formed like a hook, and attached to the lower attaching member 29 by being hooked to the above-described cutout.

As well shown in FIG. 6, each supporting plate 60 has swage parts 61 which are arranged at swage positions corresponding to the positions of the openings 41 arranged in two rows adjacent to the left and right sides of the supporting plate 60 (in this embodiment, there are 14×2=28 swage positions), and the two swage parts 61 are arranged at each of the swage positions.

The discharging needle electrodes 80 has an upstream side discharging electrodes 80*a* which are supported by the swage parts 61 so as to extend from the supporting plates 60 towards the upstream side grounded electrode plate 40, and placed so as to correspond to the openings 41 of the upstream side grounded electrode plate 40 respectively, and a downstream side discharging electrodes 80*b* which are supported by the swage parts 61 so as to extend from the supporting plates 60 towards the downstream side grounded electrode plate 90, and placed so as to correspond to the openings 91 of the downstream side grounded electrode plate 90 respectively, The upstream side discharging electrodes 80*a* extend from the swage parts 61 at the respective swage positions towards the upstream side grounded electrode plate 40 (i.e., to the upstream side of the supporting plates 60 in the direction of the flow of the dust-containing air). The upstream side discharging electrodes 80*a* are alternately bent in such a way that tip parts of the upstream side discharging electrodes 80*a* are positioned on center lines CL of the openings 41 of the upstream side grounded electrode plate 40 adjacent to the left and right sides of the respective supporting plates 60. In this configuration, as shown in FIG. 7, each of the tip parts of the upstream side discharging electrodes 80*a* and each of edge parts of the openings of the upstream side grounded electrode plate 40 are positioned so as to have a constant discharging gap G1 between them, and each of the charging areas EA1 generated by corona discharge between the upstream side discharging electrodes 80*a* and the openings 41 has a conical shape. Thus, it is possible to form uniform and stable discharging state. In this embodiment, the discharging gap G1 is set at 18.5 mm.

The downstream side discharging electrodes 80*b* extend horizontally and straight from the swage parts 61 at every third swage position toward the downstream side grounded electrode plate 90 (i.e., to the downstream side of the supporting plates 60 in the direction of the flow of the dust-containing air). Each of the downstream side discharging electrodes 80*b* and each of the upstream side discharging electrodes 80*a* supported by the swage parts 61 at the same swage position are formed in one piece. Tip parts of the downstream side discharging electrodes 80*b* penetrate the centers of the openings 91 of the downstream side grounded electrode plate 90 respectively and project to the downstream side of the downstream side grounded electrode plate 90 in the direction of the flow of the dust-containing air. In this configuration, as shown in FIG. 7, each of the parts of the downstream side discharging electrodes 80*b* penetrating the openings 91 and each of edge parts of the openings 91 are positioned so as to have a constant discharging gap G2 between them, each of the tip parts of the downstream side discharging electrodes 80*b* and each of the edge parts of the openings 91 of the downstream side grounded electrode plate 90 are positioned so as to have a constant discharging gap G3 between them, and each of the charging areas EA2 generated by corona discharge between the downstream side discharging electrodes 80*b* and the openings 91 has a parabola shape. Thus, it is possible to form uniform and stable discharging state.

In this embodiment, the charging gap G2 is set at 14.25 mm, and the charging gap G3 is set at 16.5 mm. In the case where the voltage applied between the discharging needle electrodes 80 and the upstream side grounded electrode plate 40 and between the discharging needle electrodes 80 and the downstream side grounded electrode plate 90 is −10 kV (minus charging method), it is preferable to set the charging gap G3 in the range from 16 to 18 mm, and it is optimum to set the charging gap G3 at 16.5 mm. Generally, in the case where the discharging gap G3 is determined at 1 mm when an applying voltage is 1 kV, the discharging gap G3 is 10 mm when the applying voltage is 10 kV. However, if the discharging gap G3 is set at 10 mm, abnormal discharge can occur when dirt is adhered to or deposited on the edge parts of the openings 91. We examined the discharging gap G3 which can prevent abnormal discharge when dirt is adhered to or deposited on the edge parts of the openings 91 or the tip parts of the downstream side discharging electrodes 80*b* and ensure a necessary discharging current, and we discovered that a preferable range of the discharging gap G3 is from 16 to 18 mm, and an optimum value of the discharging gap G3 is 16.5 mm. In this manner, by setting the discharging gap at a little larger value, it is possible to restrict the occurrence of abnormal discharge and carry out stable discharge when the edge parts of the openings 91 or the tip parts of the downstream side discharging electrodes 80*b* get dirty due to sucking mist.

The upstream side discharging electrodes 80*a* and the downstream side discharging electrodes 80*b* are made of titanium alloy called as Ti-6Al-4V (64 chitan). Specifically, they are made of alloy of JIS class 60 (6% A1+4% V+90% Ti), and are shaped like a fine line or a needle with a diameter in the range from 0.5 mm to 0.6 mm. Each of the tip parts of the upstream side discharging electrodes 80*a* and the downstream side discharging electrodes 80*b* is shaped like a cone, and may be ground with a rubber. For instance, each of the upstream side discharging electrodes 80*a* and the downstream side discharging electrodes 80*b* has a tip diameter in the range from 0.05 mm to 0.15 mm. In this embodiment, each of the upstream side discharging electrodes 80*a* and the downstream side discharging electrodes 80*b* has a diameter of 0.5 mm, and has a tip diameter of 0.12 mm. The opening angle of each of the tip of the upstream side discharging electrodes 80*a* and the downstream side discharging electrodes 80*b* is set at 15 degrees.

By the discharging needle electrodes 80 having such a configuration, it is possible to effectively decrease ozone generation amount, obtain excellent processability, stabilize discharge, reduce wear loss of the discharging needle electrodes 80, and achieve life prolongation. Further, since the discharging needle electrodes 80 made of Ti-6Al-4V have excellent toughness and are hardly broken, it is possible to increase durability.

Next, we will explain effects of the electric dust collector of the embodiment of the present invention having the above-described configuration.

As shown in FIG. 1, the dust-containing air (Air) generated from a processing machine such as a machining center is sucked into the main body case 1 through the inlet duct 3 and the sucking port 2 by the fan rotated by driving of the motor 8. Then, the dust-containing air flowing into the main body case 1 is rectified and filtered by the preprocessing unit 9, and thereafter flows into the charging device 6 (see FIG. 2 to FIG. 4 etc.).

As shown in FIG. 7 and FIG. 8, in the charging device 6, the dust-containing air passes through the openings 41 of the upstream side grounded electrode plate 40, and then passes through the openings 91 of the downstream side grounded electrode plate 90. When the dust-containing air passes through the openings 41 of the upstream side grounded electrode plate 40 and the openings 91 of the downstream side grounded electrode plate 90 in this manner, particles, such as dust, mist or the like, in the dust-containing air are charged, and then collected by the dust collecting device 7. In this way, the dust-containing air is filtered and purified, and then, exhausted to the outside of the electric dust collector through the exhaust port 4.

In the above-described electric dust collector of the embodiment of the present invention, uniform and stable discharging areas EA1, EA2 and EA3 are formed between the upstream side discharging electrodes 80*a* and the openings 41 and between the downstream side discharging electrodes 80*b* and the openings 91 by corona discharge. Therefore, it is possible to uniformly charge dust, mist or the like in the dust-containing air. As shown in FIG. 7, the discharging areas EA3 are discharging areas formed between each of the edge parts of the openings 91 and each of the peripheries of the downstream side discharging electrodes 80*b* (except the tip parts) corresponding to the edge parts of the openings 91 by corona discharge.

Further, in the downstream side grounded electrode plate 90, the direction of the flow of the dust-containing air and the direction of the emission of ions from the tip parts of the downstream side discharging electrodes 80*b* except the peripheries of the tip parts of the downstream side discharging electrodes are opposite to each other. This makes it easier for the emitted ions to collide with dust, mist or the like in the dust-containing air, and it becomes easier to charge dust, mist or the like in the dust-containing air. Further, the tip parts of the downstream side discharging electrodes 80*b* project to the downstream side of the downstream side grounded electrode plate 90 in the direction of the flow of the dust-containing air. Therefore, the dust-containing air is not concentrated to the tip parts of the downstream side discharging electrodes 80*b*, and further, since the directions of the emitted ions and the direction of the flow of the dust-containing air are the same as each other in the peripheries of the tip parts of the downstream side discharging electrodes 80*b*, the tip parts of the downstream side discharging electrodes 80*b* hardly get dirty. This makes it possible to keep the discharging stable for a long time and enhance durability.

Furthermore, the upstream side grounded electrode plate 40 and the downstream side grounded electrode plate 90 are placed so as to be perpendicular to the direction of the flow of the dust-containing air, and each of the upstream side grounded electrode plate 40 and the downstream side grounded electrode plate 90 has the multiple openings 41 and 91. Thus, the upstream side grounded electrode plate 40 and the downstream side grounded electrode plate 90 has the function of rectifying the dust-containing air, in addition to the function as a grounding board of the charging device 6. Therefore, it is not necessary to add another rectifying plate. Accordingly, it is possible to reduce costs.

Each of the upstream side grounded electrode plate 40 and the downstream side grounded electrode plate 90 is detachably attached to the frame body 20 and formed of one sheet of sheet metal. Therefore, when the upstream side grounded electrode plate 40 or the downstream side grounded electrode plate 90 gets dirty due to adhesion or deposition of dust or mist, it is possible to easily clean it and enhance maintainability, and further, it is possible to decrease the number of parts and reduce costs. Furthermore, the upstream side grounded electrode plate 40 and the downstream side grounded electrode plate 90 are arranged so as to be perpendicular to the direction of the flow of the dust-containing air and thus obstacle the flow of the dust-containing air, and arranged so as to be parallel to each other. By this configuration, it is possible to shorten the length of the charging device 6 in a longitudinal direction (the direction of the flow of the dust-containing air), and shorten the length of the electric dust collector in a longitudinal direction. Accordingly, it is possible to downsize the products.

Incidentally, although the embodiment of the invention described above is a preferred form of an electric dust collector of the invention and thereby contains technically preferable limitations, the scope of the invention is not limited to it, unless otherwise specified. Namely, the above-described constitutive elements in the embodiment of the invention can be appropriately replaced with existing constitutive elements and various modifications including combinations with other existing constitutive elements are possible. The invention described in the claims is not limited to the embodiment described above.

INDUSTRIAL APPLICABILITY

The art of present invention is expected to be applied to an electric dust collector for sucking and collecting particles or oil mist generated in a processing factory.

EXPLANATION OF REFERENCE NUMBERS

6 charging device
7 dust collecting device
40 upstream side grounded electrode plate
41 opening
60 supporting plate
80*a* upstream side discharging electrode
80*b* downstream side discharging electrode
90 downstream side grounded electrode plate
91 opening

The invention claimed is:

1. A charging device for charging particles such as dust, mist or the like in dust-containing air by using corona discharge generated by applying a high voltage, comprising:

a downstream side grounded electrode plate which is placed so as to obstruct a flow of the dust-containing air and has a plurality of openings for allowing the dust-containing air to pass therethrough;

an upstream side grounded electrode plate which is placed on an upstream side of the downstream side grounded electrode plate in the direction of the flow of the dust-containing air so as to obstruct the flow of the dust-containing air, and has a plurality of openings for allowing the dust-containing air to pass therethrough;

a supporting plate which is placed between the downstream side grounded electrode plate and the upstream side grounded electrode plate;

a plurality of downstream side discharging electrodes which are supported by the supporting plate so as to extend from the supporting plate towards the downstream side grounded electrode plate, and placed so as to correspond to the plurality of openings of the downstream side grounded electrode plate respectively; and a plurality of upstream side discharging electrodes which are supported by the supporting plate so as to extend from the supporting plate towards the upstream side grounded electrode plate, and placed so as to correspond to the plurality of openings of the upstream side grounded electrode plate respectively, wherein tip parts of the plurality of downstream side discharging electrodes penetrate the plurality of openings of the downstream side grounded electrode plate respectively and project to a downstream side of the downstream side grounded electrode plate in the direction of the flow of the dust-containing air, each of the tip parts of the plurality of downstream side discharging electrodes and each of edge parts of the plurality of openings of the downstream side grounded electrode plate are positioned so as to have a predetermined gap between them, tip parts of the plurality of upstream side discharging electrodes are positioned on a downstream side of the upstream side grounded electrode plate in the direction of the flow of the dust-containing air, and each of the tip parts of the plurality of upstream side discharging electrodes and each of edge parts of the plurality of openings of the upstream side grounded electrode plate are positioned so as to have a predetermined gap between them.

2. A charging device according to claim 1, wherein corona discharges are formed between the tip parts of the plurality of downstream side discharging electrodes and the plurality of openings of the downstream side grounded electrode plate respectively, and corona discharges are formed between the tip parts of the plurality of upstream side discharging electrodes and the plurality of openings of the upstream side grounded electrode plate respectively.

3. A charging device according to claim 1, wherein the upstream side grounded electrode plate and the downstream side grounded electrode plate are shaped like a flat plate respectively, and placed so as to be perpendicular to the direction of the flow of the dust-containing air, to face each other and to be parallel to each other.

4. A charging device according to claim 1, wherein an area of each of the plurality of openings of the downstream side grounded electrode plate and a total area of the plurality of openings of the downstream side grounded electrode plate are larger than an area of each of the plurality of openings of the upstream side grounded electrode plate and a total area of the plurality of openings of the upstream side grounded electrode plate respectively.

5. A charging device according to claim 1, wherein, when viewed from the direction of the flow of the dust-containing air, the plurality of openings of the upstream side grounded electrode plate are arranged on both sides of the supporting plate in a zigzag pattern, and the plurality of openings of the downstream side grounded electrode plate are arranged such that their centers correspond to the supporting plate.

6. A charging device according to claim 1, wherein each of the plurality of upstream side discharging electrodes and each of the plurality of downstream side discharging electrodes are formed in one piece.

7. A charging device according to claim 1, wherein each of the plurality of upstream side discharging electrodes and the plurality of downstream side discharging electrodes is shaped like a cone, and has a tip diameter in a range from 0.05 to 0.15 mm.

8. A charging device according to claim 1, wherein the tip parts of the plurality of upstream side discharging electrodes are alternately bent so as to correspond to the plurality of openings of the upstream side grounded electrode plate positioned adjacent to both sides of the supporting plate.

9. A charging device according to claim 1, wherein, when viewed from the direction of the flow of the dust-containing air, the tip parts of the plurality of upstream side discharging electrodes are arranged so as to correspond to centers of the plurality of openings of the upstream side grounded electrode plate, respectively, and the plurality of downstream side discharging electrodes are arranged so as to correspond to centers of the plurality of openings of the downstream side grounded electrode plate, respectively.

10. An electric dust collector comprising the charging device according to claim 1, wherein a dust collecting device for collecting the particles charged by the charging device and a fan for sucking the dust-containing air are arranged in series in this order from an upstream side in the direction of the flow of the dust-containing air.

* * * * *